US005802938A

United States Patent [19]

Fournier et al.

[11] Patent Number: 5,802,938

[45] Date of Patent: Sep. 8, 1998

[54] SLITTER FOR USE WITH ROLLED MATERIAL

[76] Inventors: Emile Fournier, 179 Edgeland Road. N.W., Calgary, AB, Canada, T3A 2Y3; David Markevich, 4040 Edgevalley Landing, N.W., Calgary, Alberta, Canada, T3A 5H1

[21] Appl. No.: 757,499

[22] Filed: Nov. 27, 1996

Related U.S. Application Data

[60] Provisional application No. 60/007,814 Nov. 30, 1995.

[51] Int. Cl.[6] ..... B26D 7/14

[52] U.S. Cl. ..... 83/18; 83/175; 83/374; 83/375; 83/459

[58] Field of Search ..... 93/13, 17, 18, 93/56, 175, 176, 451, 452, 459, 374, 375, 649; 225/43, 46, 93; 242/571, 571.6, 576

[56] References Cited

U.S. PATENT DOCUMENTS

| | | | |
|---|---|---|---|
| 4,848,201 | 7/1989 | Urwyler et al. | 83/649 |
| 4,880,152 | 11/1989 | Trankle | 83/649 |
| 5,392,676 | 2/1995 | Drury | 83/649 |

*Primary Examiner*—Maurina T. Rachuba
*Attorney, Agent, or Firm*—Sheldon H. Parker

[57] ABSTRACT

A slitting machine for cutting rolled material is disclosed which is maintained in position through use of a support frame. A support cylinder is unmovably connected to the support frame at one end. An expansion rod is centered within the support cylinder with one end extending through the frame and affixed to a lever. A rigid sleeve, preferably having a slick surface, is over the support cylinder. A motor is incorporated with a receiving channel receive the support cylinder is attached to the support frame. A flexible expansion ring is placed in contact with the motor, to allow it to revolve with the motor. A bearing and washer, with diameters greater than than the base leg of the rigid sleeve are placed between the connector affixed to the expansion rod and the support cylinder. The lever is equipped with a gear which, when the lever is placed in a locked position, shortens the distance between the connector and the support frame. A cutting device is movable horizontally along a blade support rod. The cutting device has a handle which comprises a guidance bar and an activation bar which is approximately parallel to, and spaced from, the guidance bar.

19 Claims, 6 Drawing Sheets

SLITTER FOR USE WITH ROLLED MATERIAL

This is a continuation-in-part of copending application Ser. No. 06/007,814 filed on Nov. 30, 1995.

BACKGROUND OF THE INVENTION

1. Field of the Invention

The instant invention relates to a novel slitting machine for use in cutting rolled material, such as magnetic, vinyl, reflective, pre-mask and banner material. The slitter uses an expansion ring to lock the roll of material into place while preventing the rolled material from fanning out from the core. The activation handle locks the blade in position during use to maintain accurate cutting.

2. Brief Description of the Prior Art

Rolled materials are used in many areas for various end uses. Because the final products can range from display banners to car detailing strips, a machine used for cutting the material must be highly adjustable and accurate. The material cut by the machines is highly varied as to weight and resistance to the cutting blade, as well as the width of the cut. Prior art machines have been large lathe-like devices which are heavy and extremely expensive.

The disclosed machine overcomes the problems associated with the prior art by allowing for accurate cuts to be obtained in an easily portable machine.

SUMMARY OF THE INVENTION

A slitting machine for cutting rolled material is disclosed which is maintained in position through use of a support frame. A support cylinder has one end unmovably connected to the support frame. An expansion rod is centered within the support cylinder with one end extending through the frame and affixed to a lever. A rigid sleeve, preferably having a slick surface, is placed over the support cylinder. The rigid sleeve is preferably a T-shaped cylinder to form shoulders. A T-shaped motor with a receiving channel dimensioned to receive the support cylinder and expansion bar is attached to the support frame.

A flexible expansion ring is in contact with the motor to allow the expansion ring to revolve with the motor. One edge of the expansion ring abutts the motor while the other edge abutts the rigid sleeve. A bearing and washer, with diameters greater than the base leg of the rigid sleeve are placed between a connector affixed to the expansion rod and the support cylinder to prevent the end of the expansion rod from entering the support cylinder. The lever is equipped with a gear which, when the lever is placed in a locked position, shortens the distance between the connector and the support frame. The illustrated gear has a graduated curved surface and a locking position for the lever. Moving the lever along the graduated curve to the locking position causes said expansion rod and rigid sleeve to move, contracting the flexible expansion ring and forming an arch in the ring.

A cutting device is movable horizontally along a blade support rod to cut the rolled material. The cutting device has a handle which comprises a guidance bar and an activation bar which is approximately parallel to, and spaced from, the guidance bar. A fulcrum tab is positioned between the guidance and activation bars. A support bolt extends through the guidance and activation bars maintaining a fixed distance between them. Preferably the switching device is placed between the guidance and activation bars to allow for activation upon the application of pressure to the activation bar. The horizontal blade support receiving area is a receiving channel at the end of the guidance bar and dimensioned to receive the blade support rod. The receiving channel is open through use of a channel slot, thereby bisecting the guidance bar. A lock bolt is connected at one end to the activation bar and the other end to the guidance bar, extending through the channel slot. Thus, when the activation bar is pressed, the receiving channel is compressed to lock the handle means onto the horizontal blade support rod. A stop bolt, at right angles to the handle means, comes in contact with an upper support bar thereby preventing the cutting means from cutting the rigid cover. A retaining bolt prevents the activation bar from separating too far from said guidance bar.

To cut the rolled material, the material is slid onto the rigid sleeve until it abutts the motor. The lever is moved to the locked position, thereby shortening the distance between the bearing and the support frame. This moves the rigid sleeve, compressing the compression ring to form an arch. The cutting means is moved to the desired position and the activation bar pressed, thereby activating the switch and locking the handle into position on the blade support rod. Once the rolled material is cut, the lever is moved to the unlocked position and the rolled material is removed from the rigid sleeve.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
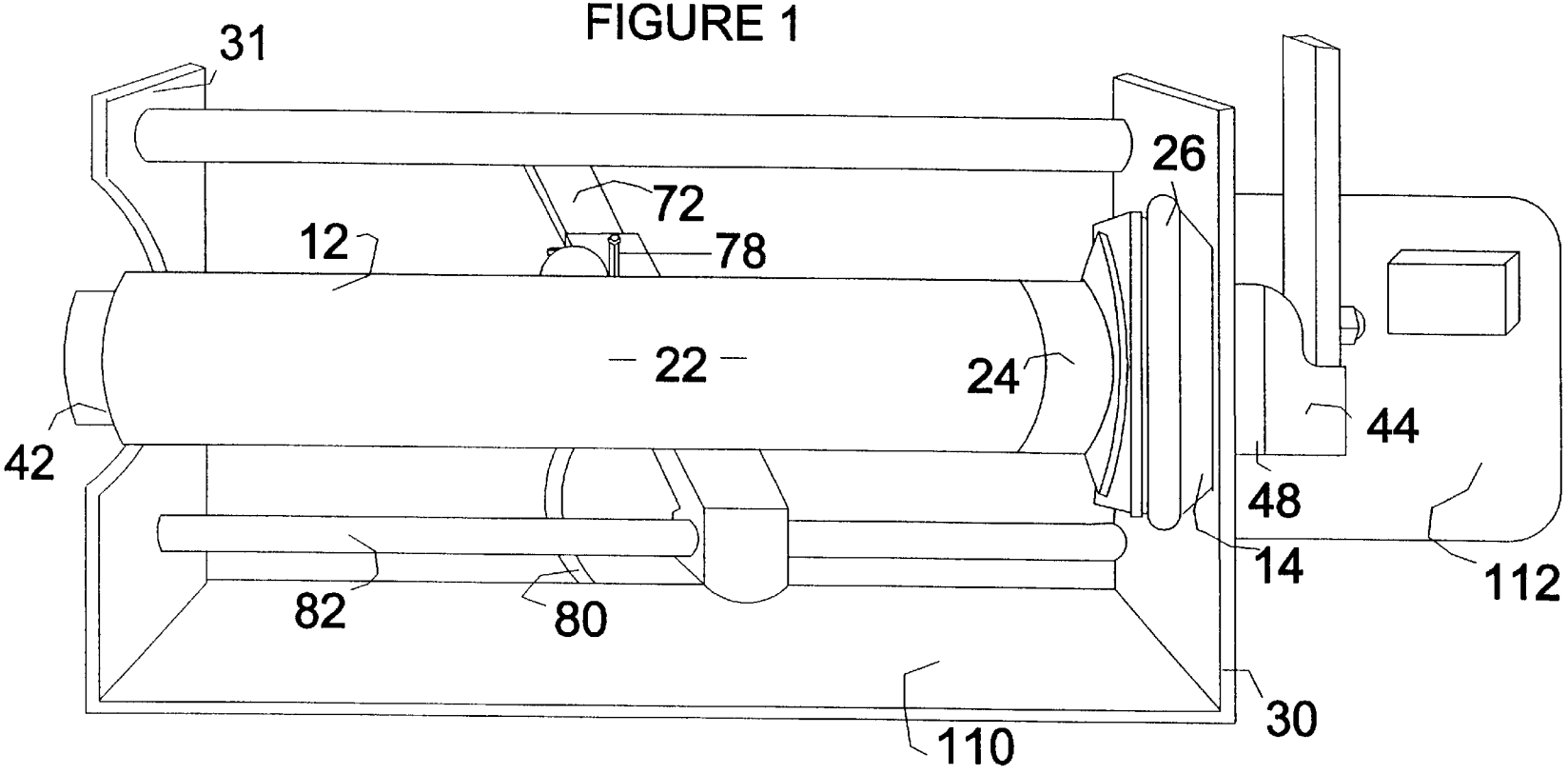
FIG. 1 is a perspective view of the assembled machine.
Figure 7:
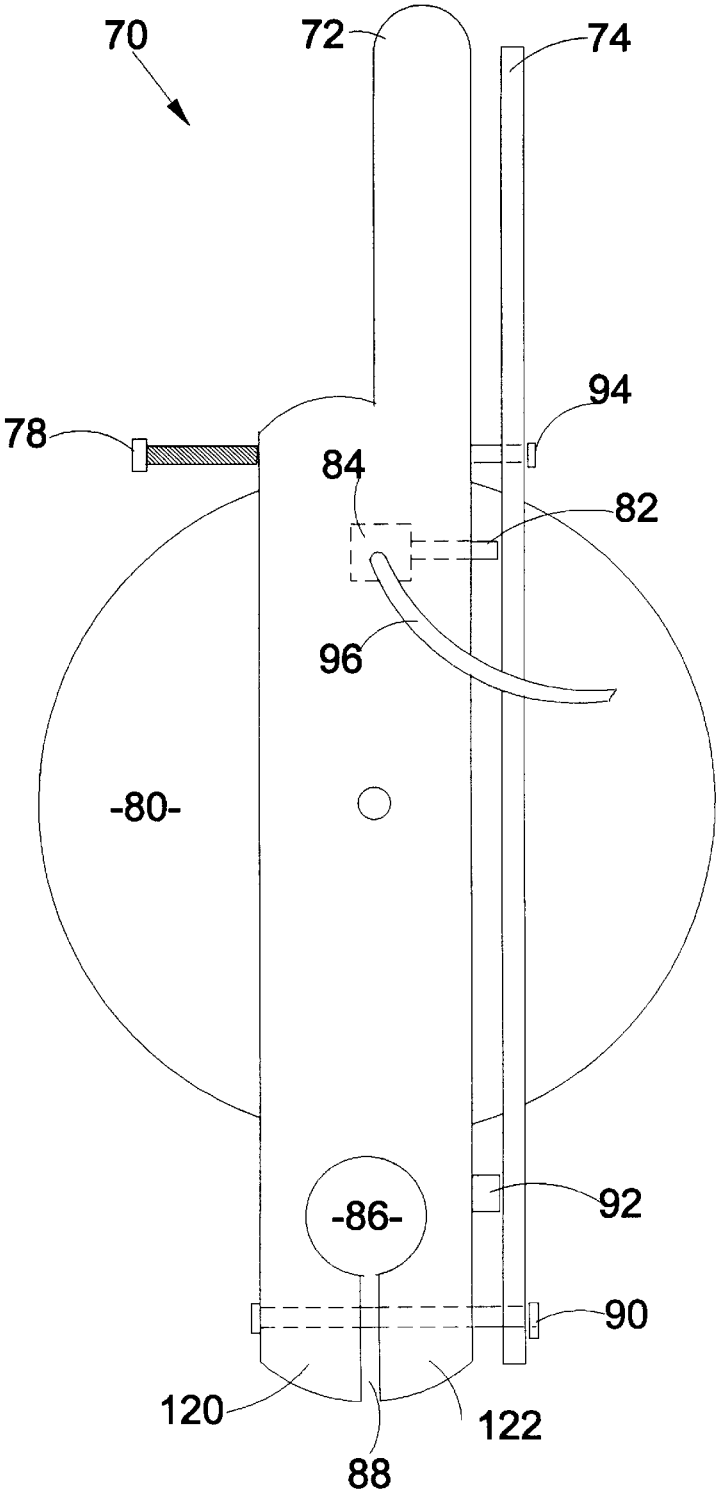
FIG. 7 is a side view of the handle of the instant invention.

The overall view of the expansion ring slitter 10 is illustrated in FIG. 1. The slitter 10 is used to accurately cut rolled materials such as packaging and adhesive tapes, pre-mask, or vinyl. The slitter is structurally supported by a motor support wall 30 and contoured wall 31, which are connected by the base frame 110. A roller shaft 12 extends from the support wall 30 at a right angle to the support wall 30. The roller shaft 12 is provided with an expansion ring 24 adjacent the drive wheel 14. The rolled material is slid onto the roller shaft 12 and abutted against the drive wheel 14 to align the rolled material over the expansion ring 24 and prevent shifting. The lever 18 is connected to, and controls, the expansion ring 24 as disclosed further herein. The rolled material is placed over the expansion ring 24 when the lever 18 is in the unlocked position. To secure the rolled material, the lever 18 is placed in the locked position, causing the expansion ring 24 to lock the rolled material into place. The blade support bar 82 extends from the support wall 30 to the contoured wall 31 and supports the cutting blade 80. Once the blade 80 is placed in the desired position above the rolled material the activation bar illustrated in FIG. 7 is squeezed, causing the drive wheel 14 to rotate and thereby rotating the expansion ring 24 and rigid cover 22. As disclosed in detail further herein, once the activation bar 74 is squeezed, the handle 70 is maintained in a fixed position relative to its position along the bar, but is free to rotate about the bar, to maintain accurate cutting. Once the roll has been cut, the lever 18 is released and the rolled material removed from the roller shaft 12.

Figure 2:
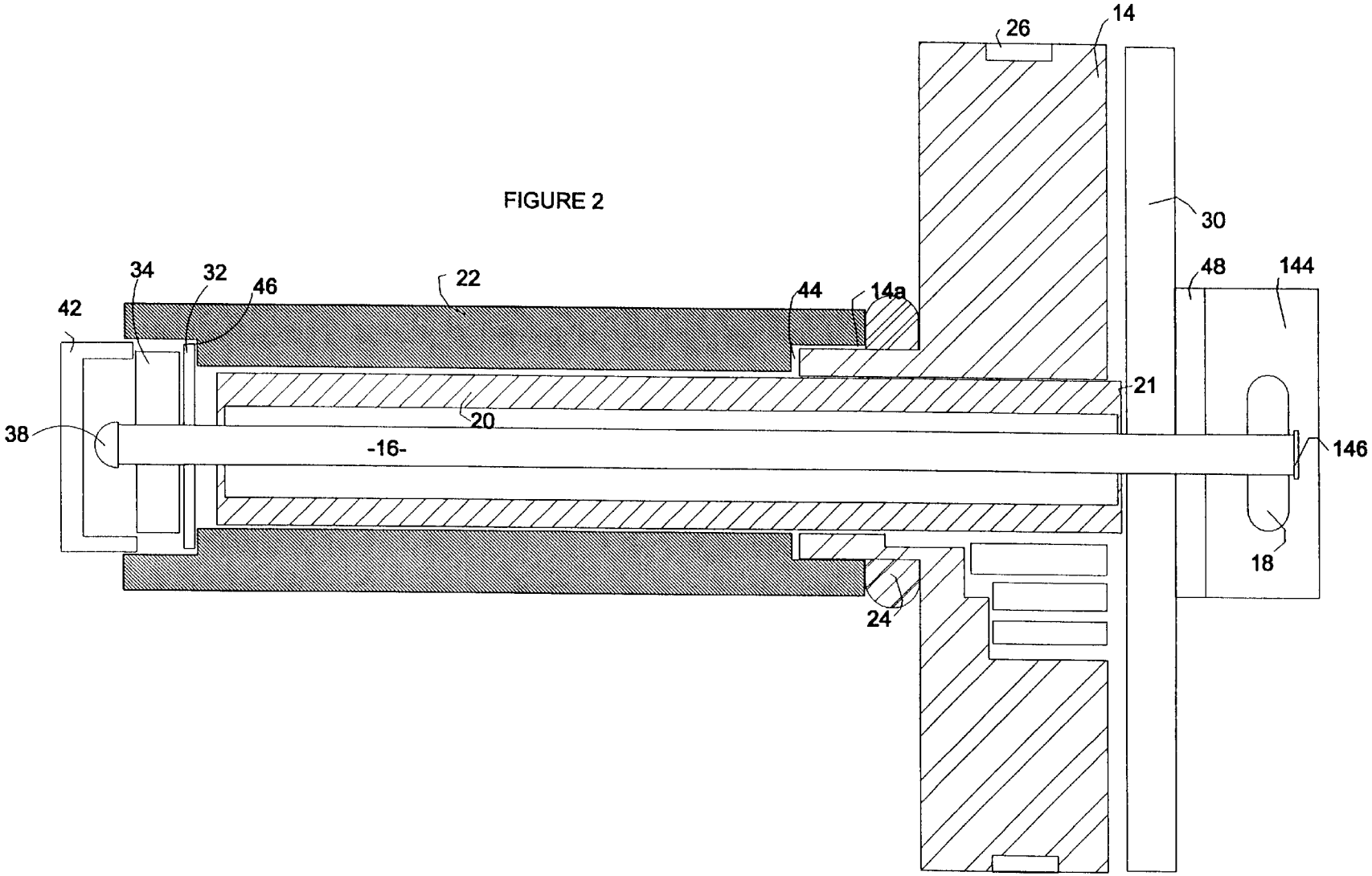
FIG. 2 is a cutaway top view of the rod assembly of the instant invention in the unlocked position.

The internal arrangement of the roller shaft 12 and drive wheel 14 in the unlocked position is illustrated in FIG. 2. The roller shaft 12 has an expansion rod 16 which extends, at the center, the length of the roller shaft 12. The expansion rod 16 is surrounded by a steel tube 20 which serves as a support for the rigid cover 22 and flexible expansion ring 24, as well as the rolled material to be cut. The tube 20 is unmovably affixed, at end 21, to the slitter wall 30 in order to provide the required rigid support for the rolled material. It is critical that the tube 20 be at right angles to the cutting blade to provide a clean, right angle cut. The tube 20 must be of sufficient thickness to support not only the weight of the rolled material but the pressure exerted by the saw blade to cut the material. Any wobble in the tube 20 will affect the accuracy of the cut. Any number of materials which meet the criteria set forth can be used to manufacture the tube 20, although steel currently provides the best cost/strength effectiveness. The rigid cover 22 is preferably manufactured from a resilient, slick material material, such as urethane, to allow the rolled material to easily slide on and off the roller shaft 12. The thickness of the rigid cover 22 must be sufficient to allow for the formation of the shoulders 46 and 44 as well as prevent buckling when pressure is applied in the direction of arrow B. The rigid cover 22 is free to slide along the steel tube 20 to allow for the compression of the expansion ring 24. Although the preferred material, urethane, is inherently slick, it is recommended that grease or other lubricant be used to minimize resistance between the tube 20 and the rigid cover 22. Conversely, the expansion ring 24 must be manufactured from a material which will deform, or buckle, upon the application of pressure. A lighter weight material, such as urethane or rubber, will provide the desired buckling.

The drive wheel 14 is connected to a motor 112 by a drive belt 26 through methods which are commonly known in the art. The drive wheel 14 is L-shaped with a flange 14*a* and, although the drive wheel 14 and flange 14*a* extend parallel to the tube 20, neither are in contact with the tube 20. The expansion ring 24 is manufactured to have an interior circumference to provide a friction fit between the expansion ring 24 and the flange 14*a*. The friction fit forces the expansion ring 24 to rotate at the speed of the flange 14*a* while the steel tube 20 remains stationary. The rigid cover 22 is placed adjacent the expansion ring 24 and locked into position through use of the expansion rod 16, thereby rotating along with the expansion ring 24.

The rigid cover 22 is manufactured in a T configuration, thereby forming shoulders 44 and 46. A washer 32 is placed within the rigid cover 22 adjacent the shoulder 46 to evenly distribute the pressure applied to the rigid cover 22. The bearing 34 is located at the end of the rod 16 and can be any type, e.g. Timkin, known in the art. The end bolt 38 locks the bearing 34 and the washer 32 onto the expansion rod 16. A cover plate 42 is placed over the end bolt 38 for aesthetics. The cover plate 42, illustrated herein, is a rigid urethane U-shaped cap which forms a friction fit within the rigid cover 22.

Figure 3:
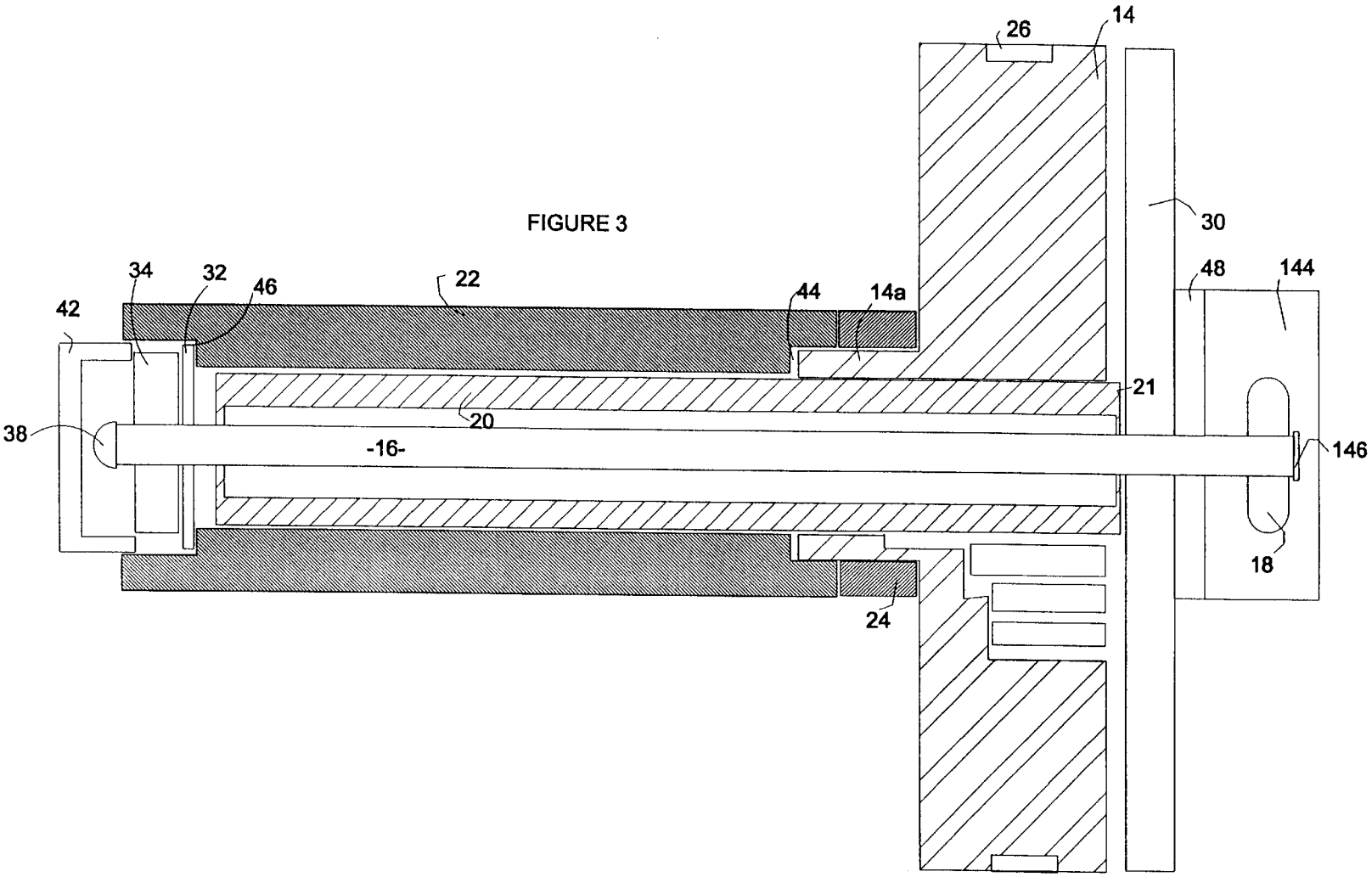
FIG. 3 is a cutaway top view of the rod assembly of the instant invention in the locked position.
Figure 4:
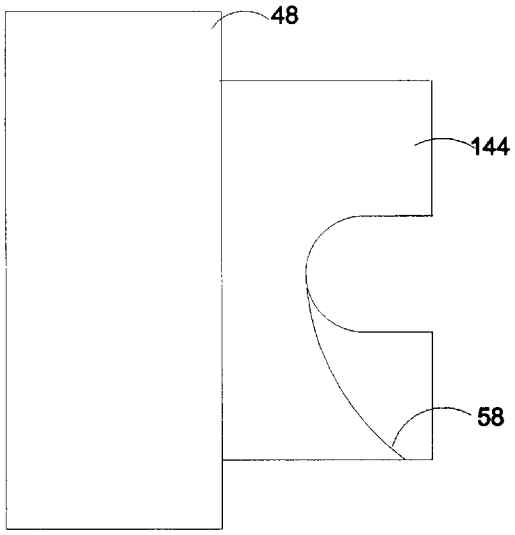
FIG. 4 is a side view of the graduated gear lock of the instant invention.
Figure 5:
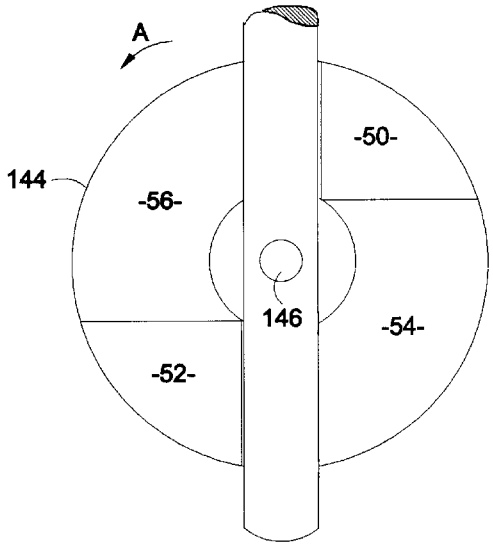
FIG. 5 is a front view of the graduated gear lock of the instant invention.
Figure 6:
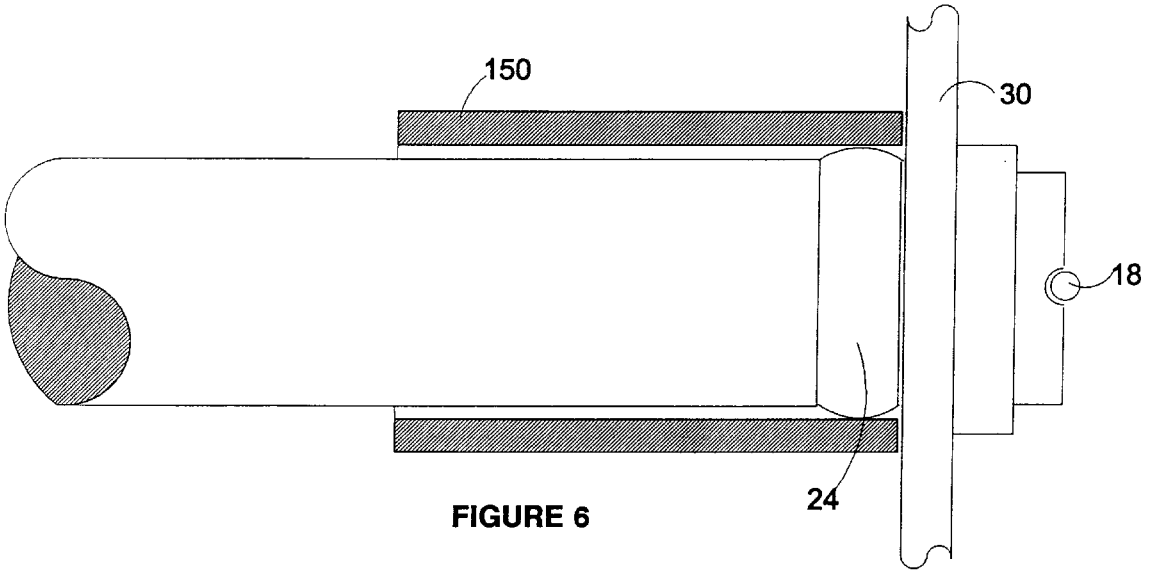
FIG. 6 is a fragmentary side view of the rod and expansion ring of the instant invention.

The expansion rod 16 extends through the tube 20 and the slitter wall 30 to the lever 18. The compression method illustrated herein is a graduated gear lock 144, illustrated in FIGS. 4 and 5. The graduated gear lock 144 is molded from any durable material, although plastics provide the advantages of being lightweight and quiet. As shown in FIG. 5, the lock 144 comprises two stops 50 and 52, which prevent the lever 18 from freely rotating around the lock 144. The rotating surfaces 54 and 56 of the lock 144 gradually raise as indicated by the slope 58 illustrated in FIG. 4. The lever 18, when pulled in the direction of arrow A travels along the slope 58, forcing the expansion rod 16 to shift in the direction of arrow B of FIG. 2. The shifting of the expansion rod 16 also shifts the rigid cover 22 in the direction of arrow B, applying pressure to the expansion ring 24. The pressure applied by the rigid cover 22 forces the expansion ring 24 to bow, as illustrated in FIG. 3. This bowing action extends the peripheral surface of the expansion ring 24 beyond the circumference of the rigid cover 22 surface. When a roll of material is initially placed on the rigid cover 22, the plane of both the rigid cover 22 and the expansion ring 24 are flush. As illustrated in FIG. 6, when the lever 18 is moved into the locked position, the expansion ring 24 is forced to bow, thereby applying pressure to the interior circumference of the core of the rolled material 150. The increased circumference of the expansion ring 24 locks the core of the rolled material 150 in position, preventing any side to side slippage during cutting. The radial expansion of the expansion ring 24 shortens the ring in width and the center of the arch which is formed moves toward the wall 30. This coincides with the need to have the rolled material 50 firmly up against the wall 30. The rolled material 50 is easily removed from the rigid cover 22 once the lever 18 is moved to the unlocked position.

It is critical that the expansion rod 16 does not shift the rigid cover 22 more than is required to slightly bow the expansion ring 24. By allowing too great a shift, and subsequently too much bowing, the expansion ring 24 can have a circumference great enough to damage lighter-weight material cores. The bowing must, however, be sufficient to hold the core in place. The amount of shift is not narrowly critical and will vary dependent upon the end use and size of the machine.

The blade activation handle assembly 70 is illustrated in FIG. 7. The assembly 70 comprises a handle or guidance bar 72 and an activation bar 74 movably connected at an angle to the guidance bar 72. To obtain the desired fulcrum effect, the activation bar 74 must be spaced from the handle 72 at an angle. The activation bar 74 is spaced to come in contact with the switch connector 82 which serves to complete the electrical connection of switch 84 mounted within the handle 72 and activate the motor 112. The switch 84 and electrical cord 96 are known in the art and can be of any design which will provide the required results. The retaining bolt 94 prevents the activation bar 74 from separating too far from the guidance bar 72. The retaining bolt 94 must not, however, restrict the movement of the activation bar 74 toward the guidance bar 72. The receiving area 86 for the blade support bar 82 is provided with a channel 88 which extends from the receiving area 86 to the end of the guidance bar 72. The channel 88 width is, in the illustrated embodiment, approximately ¼ inch, although as the dimensions of the handle assembly 70 change the channel 88 width will alter accordingly. A support bolt 90 is placed through the guidance bar 72, spanning the channel 88, and connecting the activation bar 74 to the handle 72. The support bolt is fixed to the leg 120 and passes through a channel in the leg 122. The squeezing of the activation bar and handle 72, results movement of the activation bar about the pivot point 92, and closes the space 88 between the two legs 120 and 122, since the bolt 90 is fixed to leg 120 and floats in leg 122.

A pivot bar 92 is spaced above the support bolt 90 to provide a fulcrum point. Squeezing the activation bar 74 places pressure on the electrical connector 82, activating the motor 112. The pressure further causes the channel 88 to close thereby narrowing the circumference of the receiving area 86 and increasing the pressure on the blade support bar 82. The added pressure on the blade support bar 82 prevents the handle assembly 70 from easily moving horizontally along the bar 82. The use of the fulcrum action created by the activation bar 74 pivoting around the fulcrum 92 requires very little pressure to be applied by the user to achieve the desired locking action. When the activation bar 74 is in the resting, or unsqueezed, position the handle assembly 70 can easily be moved along the blade support bar 82 and placed in the desired position. Once the blade 80 is placed in the appropriate cutting position and the activation bar 74 squeezed, the handle assembly 70 is locked in the appropriate position. This prevents the blade 80 from moving during the cutting procedure and ensures clean, accurate cuts. A stop bolt 78 is threadably connected to the handle assembly 70 and is used to adjust to the distance between the blade 80 and the rigid cover 22. The stop bolt 78 is rotated along with the handle assembly 70 and the blade 80, into contact with the upper support bar 184 thereby preventing the blade 80 from cutting into the rigid cover 22.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A slitting machine for cutting rolled material having a support frame;

a support cylinder, said support cylinder having a first end and a second end, said second end being unmoveably connected to said support frame;

lever means, said lever means being proximate said support frame;

an expansion rod, said expansion rod having a first end and a second end, said second end being affixed to said lever means, a rigid sleeve, said rigid sleeve being adjacent at least a portion of said support cylinder;

motor means, said motor means being proximate said support frame;

a flexible expansion ring, said flexible expansion ring being in contact with said motor means to allow said expansion ring to revolve with said motor means;

connection means, said connection means being affixed to said first end of said expansion rod and locking said expansion rod, said support cylinder, said rigid sleeve and said lever together;

a blade support rod, said blade support rod being affixed to said support frame;

cutting means, said cutting means being movable horizontally along said blade support rod and rotating around said blade support rod to cut said rolled material;

whereby rotating said lever means in a first direction decreases the distance between said connection means and said support frame, causing said flexible expansion ring to form an arch thereby securing said rolled material on said rigid sleeve.

2. The slitting machine of claim 1 wherein said motor means is T-shaped, having a receiving channel, said receiving channel being dimensioned to receive said support cylinder and said expansion rod.

3. The slitting machine of claim 1 wherein said rigid sleeve has a slick outer surface.

4. The slitting machine of claim 1 wherein said rigid sleeve is a T-shaped cylinder, having a first end, a second end and a base leg, said first end and said base leg forming a first shoulder and said second end and said base leg forming a second shoulder, the base leg of said T being proximate said support cylinder and said first shoulder being proximate said expansion ring.

5. The slitting machine of claim 4 further comprising a bearing, said bearing receiving said first end of said expansion rod and having a diameter greater than said support cylinder, thereby preventing said first end of said expansion rod from entering said support cylinder.

6. The slitting machine of claim 4 further comprising a washer, said washer being between said second shoulder of said rigid sleeve and said bearing whereby locking said lever and shortening the distance between said connection and said support frame, forces said washer to move said rigid sleeve to compress said compression ring.

7. The slitting machine of claim 1 wherein said flexible expansion ring is between said rigid sleeve and said motor means.

8. The slitting machine of claim 1 wherein said cutting means further comprises handle means, said handle means having switching means;

horizontal blade support rod receiving means;

whereby said cutting means is moved along said horizontal blade support rod to a desired position and said switching means is activated to activate said cutting means.

9. The slitting machine of claim 8 wherein said handle means further comprises:

a guidance bar, said guidance bar having a first end and a second end, an activation bar, said activation bar having a first end and a second end and being approximately parallel to, and spaced from, said guidance bar;

a fulcrum tab, said fulcrum tab being at said second end of said guidance bar and positioned between said guidance bar and said activation bar;

a support bolt, said support bolt extending through said second end of said guidance bar and said activation bar, maintaining said guidance bar and said activation bar at a fixed distance from one another;

wherein said switching means is spaced from said first end of said guidance bar and said horizontal blade support receiving means is a receiving channel at said second end of said guidance bar and dimensioned to receive said blade support rod whereby pressure applied to bring said activation bar proximate said handle forces said activation bar to pivot around said fulcrum, to come in contact with, and activate, said switching means.

10. The slitting machine of claim 9 wherein said receiving channel is open to said second end through a channel slot, thereby bisecting said guidance bar.

11. The slitting machine of claim 9 further comprising a lock bolt, one end of said lock bolt being connected to said activation bar and the other end of said lock bolt being connected to said guidance bolt and extending through said channel slot, whereby when said activation bar is pressed, said receiving channel is compressed to lock said handle means onto said horizontal blade support rod.

12. The slitting machine of claim 9 further comprising a stop bolt, said stop bolt being at right angles to said handle means to come in contact with an upper support bar thereby preventing said cutting means from cutting said rigid cover.

13. The slitting machine of claim 9 further comprising a retaining bolt, said retaining bold preventing said activation bar from separating too far from said guidance bar.

14. The slitting machine of claim 1 wherein said gear means has a first surface and a second surface, said first surface being affixed to said support and said second surface having a graduated curved, a locking position and securing means for said lever, whereby moving said lever along said graduated curve to said locking position causes said expansion rod to move, causing said rigid sleeve to move and contract said flexible expansion ring.

15. The slitting machine of claim 13 wherein said graduated gear means has a first surface and a second surface, said first surface being affixed to said support and said second surface having a graduated curved, a locking position and securing means for said lever, whereby moving said lever along said graduated curve to said locking position causes said expansion rod to move, causing said rigid sleeve to move and contract said flexible expansion ring.

16. The slitting machine of claim 13 further comprising a retaining bolt, said retaining bold preventing said activation bar from separating too far from said guidance bar.

17. The slitting machine of claim 1 further comprising graduated gear means, said graduated gear means being positioned along said expansion rod between said support frame and said lever means, said lever means being maintained adjacent said graduated gear means by securing means affixed to said expansion rod.

18. The method of slitting rolled material using a slitting machine having a support frame, a support cylinder, said support cylinder having a first end and a second end, said second end being unmovably connected to said support frame, an expansion rod, said expansion rod having a first end and a second end, said second end extending through said frame and being affixed to a lever, said expansion rod being centered within said support cylinder, a rigid sleeve, said rigid sleeve being a T-shaped cylinder having a slick surface and having a first end, a second end and a leg, the leg of said T being proximate said support cylinder and the first end of rigid sleeve being proximate said expansion ring, T-shaped motor means, said motor means being proximate said support frame and having a receiving channel, said receiving channel being dimensioned to receive said support cylinder and said expansion rod, a flexible expansion ring, said flexible expansion ring being between said rigid sleeve and said motor means and in contact with said motor means to allow said expansion ring to revolve with said motor means, connection means, said connection means being affixed to said expansion rod and preventing removal of said support cylinder and said rigid sleeve from said expansion rod, gear means, said gear means being adjacent said lever, and interacting with said lever to move said expansion rod, cutting means, said cutting means being movable horizontally along a blade support rod, handle means, said handle means being affixed to said cutting means and having a guidance bar, an activation bar, approximately parallel to, and spaced from, said guidance bar, a fulcrum tab positioned between said guidance bar and said activation bar, a support bolt to maintain said guidance bar and said activation bar at a fixed distance from one another and a stop bolt to prevent said cutting means from cutting said rigid cover, switching means connecting said cutting means and said motor means and being activated and deactivated by pressure applied to bring said activation bar proximate said guidance bar, a bearing, said bearing receiving said first end of said expansion rod and having a diameter greater than said support cylinder to prevent said first end of said expansion rod from entering said support cylinder, a washer, said washer being between said support cylinder and said bearing comprising the steps of:

placing said lever in an unlocked position;

sliding said rolled material onto said rigid sleeve;

placing said rolled material adjacent said motor;

placing said lever in a locked position to move said rigid sleeve to cause said expansion ring to arch;

moving said cutting means along said blade support rod to the desired position;

applying pressure to said activation bar to engage said switch and lock said cutting means along said blade support rod;

rotating said cutting means around said blade support rod;

cutting through said rolled material until said stop bold comes in contact with an upper support bar;

releasing said handle means to deactivate said cutting means;

placing said lever in the unlocked position, to move said rigid sleeve to cause said expansion ring to become flush with said rigid sleeve;

removing said rolled material from said rigid sleeve.

19. A slitting machine for cutting rolled material having:

a support frame;

a support cylinder, said support cylinder having a first end and a second end, said second end being unmoveably connected to said support frame;

lever means, said lever means being proximate said support frame;

an expansion rod, said expansion rod having a first end and a second end, said second end extending through said frame and being affixed to said lever means;

a rigid sleeve, said rigid sleeve being a T-shaped cylinder having a low friction surface and having a first end, a second end and a leg, the leg of said T being proximate said support cylinder and the first end of rigid sleeve being proximate said expansion ring;

T-shaped motor means, said motor means being proximate said support frame and having a receiving channel, said receiving channel being dimensioned to receive said support cylinder and said expansion rod;

a flexible expansion ring, said flexible expansion ring being between said rigid sleeve and said motor means and in contact with said motor means to allow said expansion ring to revolve with said motor means;

connection means, said connection means being affixed to said expansion rod and preventing removal of said support cylinder and said rigid sleeve from said expansion rod;

gear means, said gear means being positioned along said expansion rod between said support frame and said lever means, said lever means being maintained adjacent said gear means by securing means affixed to said expansion rod, said gear means interacting with said lever means to move said expansion rod;

blade support rod, said blade support rod being affixed to said support frame;

cutting means, said cutting means being movable horizontally along said blade support rod and rotating around said blade support rod to cut said rolled material;

handle means, said handle means being affixed to said cutting means and having a guidance bar, an activation bar, approximately parallel to, and spaced from, said guidance bar, a fulcrum tab positioned between said guidance bar and said activation bar, a support bolt to maintain said guidance bar and said activation bar at a fixed distance from one another and a stop bolt to prevent said cutting means from cutting said rigid cover;

switching means connecting said cutting means and said motor means and being activated and deactivated by pressure applied to bring said activation bar proximate said guidance bar;

a bearing, said bearing receiving said first end of said expansion rod and having a diameter greater than said support cylinder to prevent said first end of said expansion rod from entering said support cylinder;

a washer, said washer being between said support cylinder and said bearing;

whereby moving said lever in a first direction causes said first end of said expansion rod to move toward said support frame, causing said flexible expansion ring to form an arch thereby securing said rolled material on said rigid sleeve and enabling said rolled material to be accurately cut by said cutting means.

* * * * *